US010165804B2

(12) United States Patent
Angelino et al.

(10) Patent No.: US 10,165,804 B2
(45) **Date of Patent: *Jan. 1, 2019**

(54) BRA AND GARMENT WITH BRA PORTION

(71) Applicant: Cupid Foundations, Inc., New York, NY (US)

(72) Inventors: Anthony Angelino, Edmond, OK (US); John David Blancuzzi, Blackwell, OK (US); Lisa Ann Hand, Blackwell, OK (US); Brenda Lee Wilson, Blackwell, OK (US)

(73) Assignee: Cupid Foundations, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/983,652

(22) Filed: May 18, 2018

(65) Prior Publication Data

US 2018/0263300 A1 Sep. 20, 2018

Related U.S. Application Data

(63) Continuation of application No. 15/650,081, filed on Jul. 14, 2017, now Pat. No. 9,999,262.
(Continued)

(51) Int. Cl.
*A41C 3/08* (2006.01)
*A41D 7/00* (2006.01)
(Continued)

(52) U.S. Cl.
CPC ..... *A41C 3/08* (2013.01); *A41B 9/06* (2013.01); *A41C 3/0007* (2013.01); *A41C 3/124* (2013.01); *A41D 7/00* (2013.01); *A41D 13/0017* (2013.01)

(58) Field of Classification Search
CPC ..... A41C 3/00; A41C 3/10; A41C 3/0007; A41C 3/14; A41C 3/0021; A41C 3/0014; A41C 3/12
(Continued)

(56) References Cited

U.S. PATENT DOCUMENTS 815,747 A 3/1906 Schmitt
1,576,393 A 3/1926 Wood
(Continued)

FOREIGN PATENT DOCUMENTS

CA 2360998 A1 4/2003
GB 1187315 A 4/1970

OTHER PUBLICATIONS

International Search Report and Written Opinion for Application No. PCT/US2017/042105 dated Oct. 5, 2017.

*Primary Examiner* — Gloria Hale
(74) *Attorney, Agent, or Firm* — Botos Churchill IP Law LLP

(57) ABSTRACT

In one embodiment, a garment having a cup portion with two cups, a body portion integrated with the cup portion, and a band are disposed on the garment such that is extends beneath the cup portions. The band is either on the body portion or adjacent the body portion. The garment also has support structures with a configuration, each following proximately a contour of the lower part of its respective cup, wherein a portion of the support structure is formed on and fixed to the band and a portion of the support structure extends on the body of the garment and is attached thereto. As such the support structure configuration is approximately arcuate. The garment also has additional control regions. The control is provided by fabric or materials that have less stretch than the body fabric from which the body of the garment is made.

30 Claims, 7 Drawing Sheets

Related U.S. Application Data

(60) Provisional application No. 62/364,056, filed on Jul. 19, 2016.

(51) Int. Cl.

| | |
|---|---|
| ***A41C 3/12*** | (2006.01) |
| ***A41C 3/00*** | (2006.01) |
| ***A41D 13/00*** | (2006.01) |
| ***A41B 9/06*** | (2006.01) |

(58) Field of Classification Search
USPC ... 450/18–21, 41, 43–45, 47, 48, 51–53, 65, 450/66, 74–76
See application file for complete search history.

(56) References Cited

U.S. PATENT DOCUMENTS

| | | | | |
|---|---|---|---|---|
| 1,963,373 | A | 6/1934 | Nelson | |
| 1,994,941 | A | 3/1935 | Caldor | |
| 2,524,620 | A | 10/1950 | Cadous | |
| 2,586,267 | A | 2/1952 | Schaumer | |
| 2,711,536 | A | 6/1955 | Hartman | |
| 2,787,790 | A | 4/1957 | Kahn | |
| 2,853,077 | A | 9/1958 | Hunau | |
| 2,880,732 | A | 4/1959 | Smith | |
| 2,892,459 | A | 6/1959 | Rosenthal | |
| 2,900,981 | A | 8/1959 | Herbener | |
| 2,912,985 | A | 11/1959 | Plehn | |
| 2,940,454 | A | 6/1960 | Faron | |
| 3,378,012 | A | 4/1968 | Schwartz | |
| 4,143,662 | A | 3/1979 | Fisher | |
| 4,617,934 | A | 10/1986 | Hittel | |
| 5,215,494 | A | 6/1993 | Flanagan | |
| 9,345,273 | B2 | 5/2016 | Luxi et al. | |
| 9,999,262 | B2 * | 6/2018 | Angelino | A41C 3/08 |
| 2002/0022432 | A1 * | 2/2002 | Magrone | A41C 3/0014 450/41 |
| 2003/0082994 | A1 | 5/2003 | Mitchell et al. | |
| 2005/0277364 | A1 | 12/2005 | Redenius | |
| 2006/0025041 | A1 | 2/2006 | Falla | |
| 2007/0021035 | A1 * | 1/2007 | Bugada | A41C 3/0014 450/39 |
| 2007/0298682 | A1 * | 12/2007 | Liu | A41C 3/0014 450/39 |
| 2012/0208433 | A1 | 8/2012 | Solotoff | |
| 2014/0329438 | A1 | 11/2014 | Horii | |
| 2015/0272232 | A1 | 10/2015 | Misseldine | |
| 2017/0027241 | A1 | 2/2017 | Solotoff | |
| 2018/0020745 | A1 * | 1/2018 | Angelino | A41B 9/06 |

* cited by examiner

BRA AND GARMENT WITH BRA PORTION

CROSS-REFERENCED TO RELATED APPLICATIONS

This application is a continuation of U.S. patent application Ser. No. 15/650,081, filed Jul. 14, 2017, which application claims the benefit of the filing date of U.S. Provisional Patent Application No. 62/364,056, filed Jul. 19, 2016, the disclosures of which are hereby incorporated by reference herein.

BACKGROUND OF THE INVENTION

Women's garments configured to be worn on the upper torso have features that accommodate the female anatomy, particularly the bosom. The female figure is highly variable and most such garments are mass produced. The fact that no one style or fit suits all women in a given size category forces women to shop for particular sizes and particular fits among scores of garments, each with their own particular style and fit that may or may not work for a particular individual. Women are often required to sacrifice comfort for the fit and look that they desire.

Discomfort is particularly common in the context of underwire brassieres (also commonly referred to as bras). All women, particularly those with ample bosoms, need support, and underwire bras deliver support by providing a wire that is disposed on the bra garment and that follows along the contour of the underside of the wearer's bosom. While support is delivered by this construction, the fact is that underwire bras are often uncomfortable either because they do not adequately conform to the anatomy of the wearer or the wire itself is positioned in the garment in a manner that will cause it to jab or pinch the wearer. These problems are more often caused by the poor fit of the garment rather than the wire itself.

Consequently, garments with a bra portion that have an underwire for support that are comfortable for the wearer continue to be sought.

BRIEF SUMMARY OF THE INVENTION

Described herein is a garment for supporting a woman's breasts such as a bra or brassiere garment and garments having a brassiere or bra portion. In one embodiment, the garment has a cup portion with cups that receive the breasts of the wearer. The cups are affixed to the body portion of the garment. The body portion of the garment has features that allow the garment to be fitted onto the wearer. Such features include, but are not limited to, straps, clasps, elastic fabric, etc. Such features secure the garment on the wearer. The garment can be configured in a variety of fits and styles that are well known to those skilled in the art. Not all fits and styles are described herein and the styles and fits disclosed are by way of example and are not to be considered as limiting in any way. Unlike typical support garments, these garments conform to the wearer and do not force conformity of the wearer to the garment. Put another way, the garments described herein provide the wearer with comfort and a flattering appearance without sacrificing one for the other. The garments described herein give the wearer confidence that the garment will provide them with a consistently flattering appearance when worn without requiring the wearer to check their appearance regularly and adjust the garment to maintain their desired appearance.

The garment has a band of material disposed underneath the cup portion of the garment, i.e., when the garment is worn, the band of material is located lower on the body than the cup portion. The band of material is disposed on the body fabric of the garment. The band can be fabric or non-fabric material. Fabric bands can be conventional narrow elastic bands, folded over fabric, lace and the like. Examples of suitable non-fabric bands include silicone bands or bands made of other synthetic materials. The band may form the bottom edge of the garment if the garment is configured as a bra. In garments that extend further down the torso of the wearer (e.g. a body briefer, swimsuit, sun dress, etc.) the band is disposed beneath the cup portion and not at the bottom of the garment. In some embodiments, the band is made of an elastic material. Consequently, "band," as used herein, contemplates both elastic bands and non-elastic bands. As described in greater detail below, even if the band is not made of a material that is technically elastic, the band must be made of a material that has some ability to stretch. If the band is a synthetic material such as silicone disposed on fabric, the fabric on which the band of silicone is placed must also be stretchable. In some embodiments, the band of material defines the edge of the garment. In other embodiments, the band of material is placed away from the edge of the garment at a location that will achieve the objectives of the garment described herein. In such embodiments, the band is placed laterally beneath the cups of the garment.

As used herein, "beneath" means the location on the garment beneath the cup portion. In some embodiments, the band extends on the body portion of the garment such that it forms a substantially continuous band at least beneath the cup portion. In certain embodiments, the band will extend substantially around the garment when the garment is being worn (i.e. beginning from the backside of the garment, around the front side of the garment and terminating in the back). In these embodiments, the band may be interrupted, for example by a fastening portion of the garment. The fastening portion, as used herein, is the portion of the garment that is brought together so that it can be secured by the wearer with fasteners (e.g. zippers, clasps, etc.) when worn. The fastening portion can be any conventional fastener for such garments. Non-limiting examples include hooks, snaps, buttons, zippers, Velcro®, etc. Also, contemplated herein are garments that are not fastened together to be worn. The wearer dons such garments by either stepping into them or pulling such garments on over their head. In those embodiments where the garment does not need to be fastened together to be worn, the band is a substantially continuous band formed at least beneath the cup portion and, in some embodiments, extending around the garment.

The garment also has a support structure, typically a wire or other thin, resilient member. The wire is designed to have a shape or contour adapted for its purpose in the garment. The wire can be metal or a synthetic material (e.g., plastic). The wire is bendable, twistable, etc. in response to applied force, but returns to its particular shape or contour when the applied force is removed.

The support structure is typically disposed in a casing, but this is not required. Such casings are typically fabric, but can be other materials (e.g. a foam or silicone coating, etc.). Support structure, as used herein, includes resilient members such as wires disposed in a casing. The support structure is positioned relative to the cup portion such that it proximately follows the contour of the cups, although it might be placed a distance from the cups and is therefore not required to be placed immediately adjacent to the cups. In this regard, the support structures have an approximately arcuate shape.

The support structure is positioned on the body fabric such that at least a portion of the support structure extends onto the band disposed beneath the cup portion and is affixed to the band. The portion of the support structure disposed on and affixed to the band is referred to herein as an anchor (or anchor point or anchor region). In those embodiments where the support structure has a proximately arcuate shape, the portion of the support structure that forms the anchor region is about at the midpoint of the arc (i.e., proximate to or at the apex of the arc). Anchor, as used herein, is a defined region of the band that does not stretch or "stretches less" than other portions of the band when the garment is subjected to tension. Similarly, the position of the support structure affixed to the band to form the anchor does not adjust or change relative to the band portion to which it is affixed when the garment is subjected to tensions, stress and strain. The anchor provides stability to the garment when worn.

Affixing the support structure to the band creates the anchor point because sewing or gluing the support structure to the band reduces the ability of the band to stretch in the area of attachment. This is described in greater detail below. These anchors still allow the garment to adjust and adapt, but preserve the form, fit and function of the garment that delivers both comfort to for the wearer and preserves the wearer's appearance in the garment. The adaptation and adjustment provided by the garment described herein is not available in prior art garments. In an exemplary embodiment, the garment provides for controlled adaptation due to the anchor points. Such controlled adaptation allows the garment to fit comfortably in response to garment fit and movement of the wearer and provide a consistently attractive appearance. Therefore, the garments described herein provide advantages over garments that either have a more rigid structure that imposes a defined shape and fit onto the wearer and that do not allow for adaptation, which had the disadvantages described above, or more unstructured garments which may allow for comfort because the lack of structure is less restrictive.

On other portions of the garment, the support structure does not anchor the garment and, as a result, the support structure position can "float" in response to the garment stretch. As used herein, "float" does not mean complete and unrestricted movement of the support structure relative to the garment on which or in which it is disposed. Rather "float" means that the support structure does not significantly impede the ability of the fabric adjacent the support structure to stretch and that the support structure position will respond to stresses, strains and tensions to which the garment is subjected when worn. In this manner, the support structure and the fabric adjacent the support structure respond differently to stresses, strains and tensions to which the garment is subjected when worn.

"Body fabric" as used herein is the base fabric of the garment to which the other garment components (e.g. the cups, the straps, the band, the support structure) are attached to assemble the garment. The body fabric can be a single layer of material or multiple layers of materials. Each layer of material is conventionally referred to as a ply, with multiple layers of material being referred to as multi-ply herein.

The support structure is affixed to the garment in any conventional manner such as sewing or gluing. The support structure is typically disposed between layers of fabric. In some embodiments, the support structure is a wire disposed in a fabric casing and that casing in which the support structure is disposed is then placed on or between the layers of fabric. Disposing the support structure in fabric or in a casing prevents the support structure from poking or pinching the wearer, which would cause discomfort or irritation.

In some embodiments, the garment also has at least one control region. The control regions can be between the cups (an inner cup portion), or adjacent the outer portion of the cups. The control region is not an anchor. However, the control region does not stretch as much as the body fabric and therefor resists the garment's response to mechanical stresses or strains more than the body fabric. In some embodiments, the garment has more than one control region.

The fabric selected for the body fabric of the garment can be virtually any fabric suitable for brassieres, bras or any garment that incorporates a bra portion (including foundations, shapewear, swimwear, activewear, sundresses, etc.). Suitable fabrics typically have some stretch. The stretch is typically in all directions although fabrics that have limited or no stretch in some directions and a greater amount of stretch in other directions are contemplated as suitable. Direction, as used herein, is relative to the plane of the fabric.

In one embodiment, the garment control region is fitted between the cups. Such a control region is often referred to as a gore. The degree to which the control region between the cups controls or reduces the ability of the garment to stretch is largely a matter of design choice. Therefore, the way the control region is constructed in the garment is also a matter of design choice. The control region is not completely rigid and will stretch, although it will stretch less than the body fabric in most embodiments. The control region can be one or more layers. In some embodiments, the material is selected for the control region because it stretches preferentially in one direction. For example, in the x-y plane of the fabric a material may stretch more in the x direction than in the y direction. In some embodiments, a two-ply control region is provided where the first ply stretches more in the x direction of the fabric plane and the second ply stretches more in the y direction of the fabric plane.

The cups in the cup portion of the garment can be any conventional material. In one example, the cup is a molded fabric that, through the molding process, has a redefined stretch such that the cup retains its molded shape. Garments with cut and sewn-in cups or fiber fill foam cups are also contemplated. The cups can also be single ply or multi-ply. The garments described herein provide the wearer with a natural feeling lift that provides both confidence and comfort. While cups are typically associated with undergarments or foundation garments such as bras, the fact is that any garment contemplated herein will include a cup portion for fit and function.

In terms of the garments described herein, the garment includes a structure for supporting a woman's breasts and can be a brassiere or bra, an undergarment or shapewear garment that incorporates a bra or brassiere portion (for example, a camisole, body brief, long line bra, etc.) or a more conventional garment that incorporates a bra or brassiere portion (e.g. a sundress). Activewear garments such as swimwear or other sports or exercise garments that incorporate a bra or brassiere portion to provide the wearer with support and confidence during their selected activity are also contemplated.

A method for fabricating a bra or bra portion of a garment is also described herein. According to the method a body fabric is provided. A cup region is formed in the body fabric. The cup region includes two cups. A band of material is attached to the body fabric beneath the cup region. The band of material is stretchable. Two support structures are affixed to a portion of the band of material beneath the cup region.

Affixing the support structure to the band of material forms a region that stretches less relative to the portions of the band of material to which the support structures are not affixed. That region is referred to as the anchor herein.

The method may further include forming a first control region in fabric between the cups. The first control region is formed from a material that stretches less than the body fabric. The first control region may be a multi-ply material region that stretches less than the body fabric. In one embodiment, the first control region is formed by applying adhesive on the fabric used to form the first control region. The method may further include forming a second control region on the body fabric, where the second control region is in a sling region of the garment adjacent an arm opening of the garment. The second control region may be a multi-ply material region that stretches less than the body fabric. The second control region may be formed by applying adhesive on the fabric used to form the sling region.

Examples of suitable support structures include resilient wires, each disposed in a fabric casing. The fabric casings are affixed to the band of material to form the anchors. The support structures have a proximately arcuate configuration, where the support structures are affixed to the band of material at or near a midpoint of the proximately arcuate support structures. An apex of the support structure generally coincides with its midpoint. The method may further include tacking the wires in the fabric casings. For example, where the wires are plastic-coated wires, the plastic-coated wires are tacked in the casings by melting the coating at a tip of the wire when the wire is in contact with the casings. The method can also include fabricating a garment where the support structure casings extend beyond the end of the wires disposed in the casings. For example, the garment when formed has a perimeter. The fabric casings have first and second ends that extend beyond first and second ends of the wire disposed in the fabric casings. The first end of the fabric casing extends to a portion of the perimeter of the garment at a neck opening and is attached to the perimeter of the garment at that location. The second end of the casing extends to a portion of the perimeter of the garment at an arm opening of the garment and is attached to the garment at that location. In other embodiments, the support structure is attached to the band at a location offset from its center so that a first portion of the support structure extending from one side of the attachment is longer than a second portion extending from the other side of the attachment.

DETAILED DESCRIPTION

Figure 1:
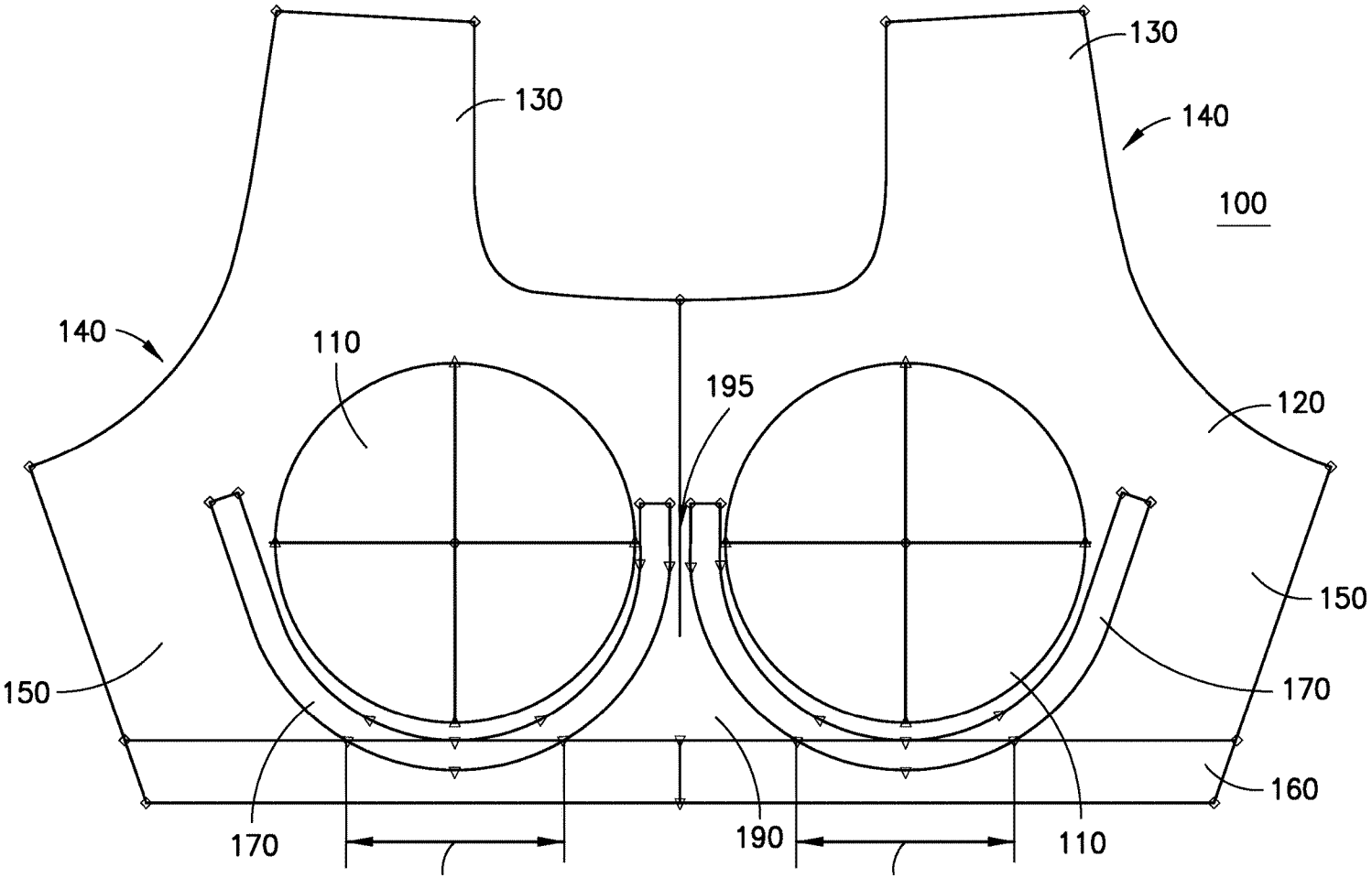
FIG. 1 illustrates a bra or bra portion of a larger garment according to one embodiment of the present invention.

An embodiment of the present invention is illustrated in FIG. 1. Illustrated as a bra or brassiere, the illustrated embodiment can be incorporated into a larger garment. The garment 100 has two cups 110. The cups 110 are assembled with and supported by the body fabric 120. The garment is illustrated in a front view with the cups projecting from the page. The garment is illustrated as having portions 130 illustrated as straps, but straps are optional. The openings 140 fit around the arms and shoulders of the wearer. The mechanism by which the garment 100 is secured on the wearer is not illustrated. Typically, the body of the garment extends around the wearer's torso and the ends of the body of the garment terminate adjacent each other in the mid shoulder region of the wearer's back where the ends of the garment are fastened together to secure the garment onto the wearer. However, the securement mechanism is not absolutely required to be in any one location although garment design and function may drive a particular placement. The portions of the garment that extend beneath the arms and around to the back of the wearer where they are fastened (referred to as bra wings in the context of those garments), are portions 150. In FIG. 1 portions 150 and 130 are also formed from the body fabric. In some embodiments, cups 110 are molded body fabric, whereby the body fabric is shaped to form the cups. In other embodiments, the cups 110 are foam cups or other cups incorporated into the garment by attaching the cups to the body fabric 120 of the garment by sewing, gluing, etc. The garment supports the cups and secures them on the wearer. In this manner, the cups can be integrated into the garment either by molding the body fabric to include cups or by attaching the cups to the body fabric. The cups can be single ply or multi-ply. In another embodiment, the garment is formed with the cups through molding of the cups into the body fabric. In some embodiments, the cups can have a foam middle layer with body fabric disposed on either side of the foam.

The body of the garment illustrated in FIG. 1 can also be single ply or multi-ply. In one example, the garment may have a lace outer layer disposed on a layer of body fabric. An additional layer might be placed on the inner portion of the garment. In the context of garments, the inner portion is the portion closest to the wearer and the outer portion is furthest away from the wearer. The skilled person is aware of the many ways in which a garment such as a bra can be constructed, the fabric used and the number of fabric layers in the garment. These conventional aspects of garment design are not described in detail herein.

Bras or brassieres and garments that incorporate them are made using a variety of manufacturing techniques including sewing, gluing, etc. The bras or brassieres and the garments that incorporate the bras and brassieres described herein are not limited to any one manufacturing technique nor any one way of securing the garment components together.

The garment has a band 160 disposed on the garment body in a location beneath the cups 110. As noted above, the band 160 is made of a material that stretches to some degree. Put another way, pulling or applying tension on the band 160 causes the band to stretch. In FIG. 1, the band 160 is illustrated as the finished lower edge of the garment 100. However, in other embodiment the garment 100 may extend lower on the torso of the wearer such that the band 160 is placed in the illustrated location relative to the cups 110 but is not the finished lower edge of the garment. In some embodiments, the band 160 is a narrow elastic. However, the band 160 may be silicone or simply folded over fabric or some other fabric with sufficient stretch to perform the function of the band as described herein. In this manner, the band may be made using the same fabric that forms the body portion, but modified in some way to provide a different stretch than that of the body fabric. Modifications in the stretch of the portion of the body fabric that forms the band are achieved by, for example, folding the fabric on itself, depositing silicone or other adhesive on the portion of the body fabric, or other techniques for causing a change in the way a fabric stretches. Such techniques are well known to one skilled in the art. When the band is formed from the same piece of fabric used for the garment body fabric, the band is described herein as monolithic with the body portion. Indeed, the band material can be any conventional material used in garments provided that the band material stretches to some degree. Additional examples of stretchable material include spandex, elastane (Lycra), Lastex and Nylon. Certain synthetic fabrics and other materials may also be considered stretchable provided elastomeric fibers are disposed therein, such as denim with elastic fibers interwoven with cotton fibers. In contrast, some materials do not provide the described stretching function. For example, cotton, linen, silk, wool and leather are typically not considered to be stretchable. Nor are synthetic fabrics such as acetate, chiffon, organza and velvet typically viewed as stretchable materials. Typically, the ability of a material to stretch depends on whether the material has some elasticity. For example, when a fabric includes a plurality of fibers, at least some of those fibers are elastomeric if the fabric is to be stretchable. The degree to which the band will stretch is largely a matter of design choice.

The band portion as illustrated extends laterally below the cup portion of the garment. As noted above, when the garment incorporates a bra or brassiere portion as part of a larger garment (e.g. a swimsuit, a camisole, a sundress), the band is disposed beneath the cups but not at the edge of the garment, as the garment extends lower on the torso of the wearer and therefore the edge of the garment is removed from where the band is placed. The distance between the cups 110 and the band is largely a matter of design choice. However, the location of the band 160 is somewhat defined by the placement and trajectory of the support structures 170 on or in the garment since the support structures are affixed to the band at the anchor regions.

The support structures 170 are wires or other long resilient structures (known typically as underwires) that provide support to the wearer. The placement of the support structures 170 is such that they are disposed on both the body fabric 120 and the band 160. The portion of the support structures that travel over and are affixed to the band form the anchor region 180. Anchor regions provide what is referred to herein as a "natural lift" to the wearer. The natural lift provides the wearer with comfortable support that enhances the appearance of the wearer consistently when the garment is worn. Such consistent enhancement provides the wearer with both comfort and confidence. The support structures 170 are affixed to the band 160 by any conventional technique for garment fabrication including, but not limited to, sewing or gluing. Affixing the support structure to the band reduces the stretch of the band 160 relative to the stretch of the other portions of the band that are not affixed to the support structures.

The support structures 170 are also fastened to the body fabric 120 by any conventional mechanism, examples of which are sewing and gluing. However, such fastening of the support structures 170 to the body fabric does not create an anchor. There are several reasons why the attachment of the support structure to the band forms and anchor but attachment of the support structure to the body fabric does not form an anchor. These factors include the support structure configuration and placement and the differences between band material and body fabric material. As noted herein, the support structure is typically elongate, resilient and has a relatively thin cross section. As such these supports flex more at their terminus than they do in their center. When the proximate midpoint, or apex, of the support structure forms the anchor, the midpoint is much less susceptible to flexing than the terminal ends of the support structure. Also, in the garments described herein the body fabric is typically lighter and has more stretch than the band material. For these and other reasons attachment of the support structure to the band forms an anchor region while attachment of the support structure to the body fabric does not. Although the support structures can be attached to the band and body fabric using any suitable technique for attachment, gluing provides for a smoother looking garment when worn. The support structures 170 are typically enclosed in fabric or other materials, which are often referred to as casings.

Support structures, as used herein, include support structures with and without casings or coatings. In one embodiment, the support structures 170 are wires (typically referred to as underwires because they are disposed beneath the cups 110). Wires for garment construction are well known and not discussed in detail herein. Such wires come in a wide range of shapes and materials. Although referred to herein as wires, the support structure cross-section is not required to be circular, and can be rectangular, elliptical, oval, etc. Whatever wire cross section that is selected, the support structure will flex in response to garment stress, strain and tension and then release to its natural position when such tension, strain or stress is removed. The skilled person is aware of how garments with underwire structures are constructed. The way the wires are incorporated into the garment is largely a matter of design choice. In some embodiments, the wires are encased in fabric casings and disposed on the surface of the garment (i.e. the surface of the garment in contact with the wearer). In other embodiments, the wires are disposed between garment layers (either in casings or not in casings). In such constructions, the support structures 170 are disposed between plies of fabric and will not poke or pinch the wearer.

The two support structures 170 are placed so that there is a space between them at 195 even at the portion on the garment in which they are most proximate to each other. This permits the support structures to move toward each other in response to tensions to which the garment 100 is subjected. This underscores a feature of the garment, i.e. that the portions of the support structures 170 that are not disposed on the band do not form an anchor allowing the garment fabric to stretch and the position of the support structures 170 to adjust somewhat independently, which improves the fit, look and comfort of the wearer.

The support structures 170 follow proximately the contour of the cups 110 and are placed at a distance therefrom. In one embodiment, the support structure has an approximately arcuate shape. In a variant, to the extent a particular curved shape is not considered arcuate, such curved shapes are also contemplated for the support structure. While the distance of the support structures 170 from the cups 110 is largely a matter of design choice, placement of the support structures 170 requires that a portion of each support structure is disposed on the band 160 with the support structures 170 extending onto the body fabric approximately conforming to the contour of the cup 110. As illustrated in FIG. 1, the support structures extend at least about halfway up on both sides of the cup, but this is not required. The support structures can extend further up the cup than illustrated and can extend less up the cup than illustrated. For example, sides of each support structure can extend less than or further up the cup than illustrated in FIG. 1. However, if the portion of the support structures that terminate between the cups terminate in the region 195, this provides the wearer with better support. In a variant, an outer portion of a support structure can extend up the cup more than an inner portion, where the outer and inner portions both extend from the portion attached to the band but in opposite directions. In this way, a portion of the support structure closest to the arm opening extends to a further or lesser extent from the band than a portion of the support structure closest to the gore of the garment.

The embodiment illustrated in FIG. 1 has a control region 190. Such a control region may still have some give or stretch but not to the extent of other portions of the garment body (e.g. body fabric portions 120, 130, 150) that do not function as a control region. Such a control region (also referred to as a gore) are well known to one skilled in the art. The control region can be almost rigid, but has at least some ability to stretch in response to tensions, stress and strains to which the garment is subjected. A control region can be formed from one or more layers of fabric that are less stretchable than the body fabric. A control region can also be formed by applying adhesive or silicone to the fabric which reduces its ability to stretch. The control region is advantageous in that it keeps the cups aligned with respect to one another. This mitigates the risk of misalignment of the garment when worn.

Figure 2:
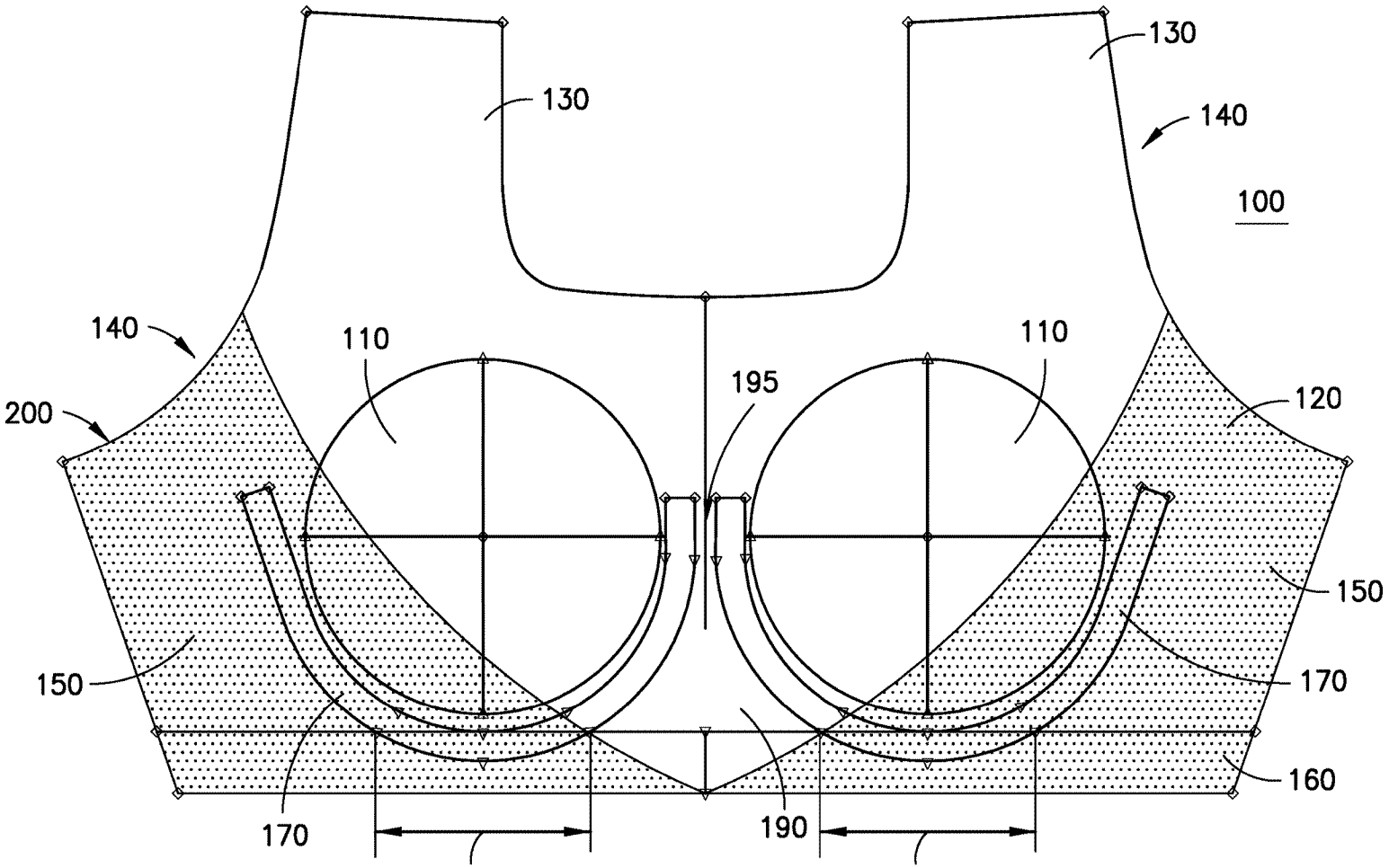
FIG. 2 illustrates a bra or bra portion with a bra sling control region according to a second embodiment.

FIG. 2 illustrates a second embodiment in which the garment has a second control region 200. That control region 200 is formed as described above, using fabric that stretches less than the body fabric. As illustrated in FIG. 2, the control region 200 forms the portion of the garment typically referred to as the bra sling. As illustrated in FIG. 2, a portion of the support structures 170 (and any casing in which the support structures are disposed) is located in this control region 200. The control region 200 does not restrict the ability of the support structures disposed therein to respond to tensions, stress and strain to which the garment is subjected due to fit (e.g., snug, relaxed, etc.) or movement of the wearer. As noted above, the control region can be either fabric, silicone or adhesive applied to fabric that reduces the ability of the fabric to stretch. The control region 200 can be between the support structure and the wearer or the support structure can be between the control region and the wearer. In those embodiments where the control region is multi-ply, the support structure can be disposed between the plies of the multi-ply control region. It is important to note that, even if the control region is adhesive applied on fabric, the adhesive is applied to reduce the ability of the fabric to stretch and not to anchor the support structure to the control region. Because each control region as described does not stretch as much as the body fabric, it resists the garment's response to mechanical stresses or strains more than the body fabric, advantageously allowing the body fabric to adjust to the wearer while resisting such adjustments at the control region or regions. Additionally, control region 200 is advantageous in that it keeps the cups from migrating laterally across the chest, thereby maintaining spacing between the cups when the garment is worn. Thus, control region 190 and control region 200 both assist in maintaining the relative position of the cups when the garment is worn.

The extent to which the support structures contact the band 160 is also largely a matter of design choice. As illustrated in FIG. 1, the entire width of the support structure 170 is over and affixed to the band 160, but this is not required. In some embodiments, the support structure is only affixed to the band 160 at the edge of the band. Provided the attachment between the support structure and the band is secure, a functional anchor region exists on the garment. In some embodiments, only the casing portion of the support structure is affixed to the band. In this regard, the area of the anchor region 180 is a matter of design choice. As illustrated, the support structures have an approximately arcuate shape and an area proximate the midpoint of the support structure forms the anchor region 180. Such positioning is not required, as some other portion of the support structure can be used to form the anchor region. For example, where the support structure extends further on one side of an attachment point with a band than on another side, an anchor region is formed at a portion of the support structure that encompasses an apex of the support structure, and the midpoint of the support structure is offset to the side with the longer extent of the support structure.

Figure 3:
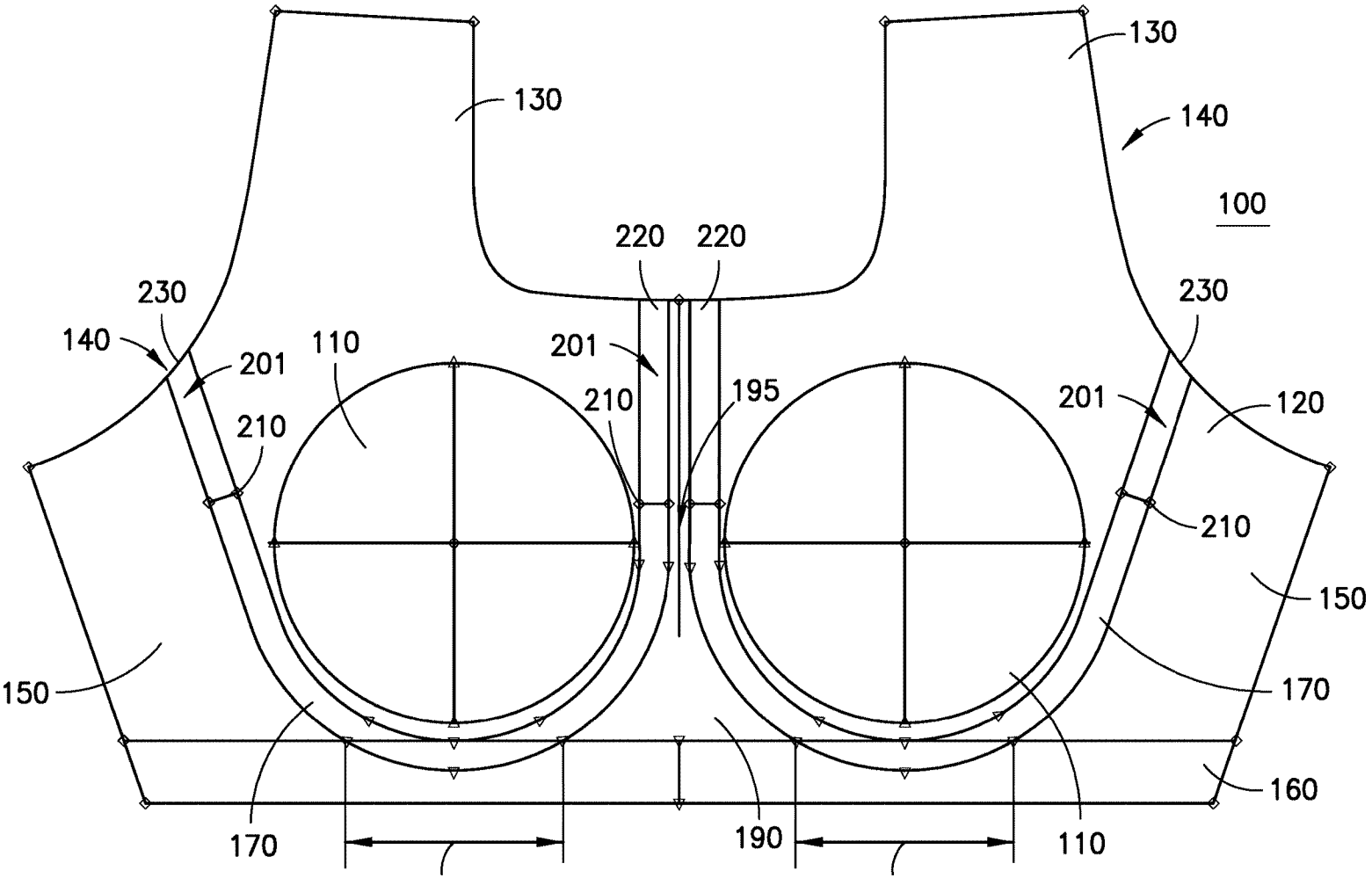
FIG. 3 illustrates a bra or bra portion with support structures having fabric casings that extend to the garment perimeter according to a third embodiment herein.

In those embodiments where the support structure includes a fabric casing, the interior structure (e.g. the wire) is secured in the casing to prevent the interior structure from migrating within the casing. This is accomplished by tacking the wire in the casing. As illustrated in the embodiment of FIG. 3, the fabric casings 201 extend beyond the location 210 where the interior structure terminate and are tacked. The fabric casings 201 extend from the location 210 to the edges of the garment in the neck portion, 220, and the sling portion 230. Extending the fabric casings stabilizes the support structures without restricting the ability of the support structures to adjust position as the garment shifts and stretches when worn.

Support structures having an interior structure disposed in a casing are well known. Tacking interior structures in casings to retain the interior structure in the casing is also well known to one skilled in the art and not described in detail herein. Such tacking does not create anchor regions in the garment because tacking does not create a region of less stretch flanked by regions of more stretch. In some embodiments, the support structures 170 themselves extend even further up the garment than as illustrated in FIG. 1 (i.e. beyond approximately midway up the cup).

As discussed above, some portion of the support structures 170 are affixed to the band 160. In those embodiments where the support structure has a casing portion, the casing portion may be the portion of the support structure affixed to the band. The points at which the support structures are affixed to the band create an anchor region (i.e., a region that stretches significantly less than the portions of the band to which the support structure is not affixed). In some embodiments, the anchor portion of the band does not stretch at all in response to normal tensions, stresses and strains place on the garment when it is worn. The support structures are otherwise allowed to move in response to the movement of the garment as it is worn. That is, the position of the support structures will adjust relative to the wearer. In those embodiments where the support structure is an interior structure within a fabric casing, the degree to which the interior structures adjust is constrained by the casing and how the casing is affixed to the garment. In those embodiments where the support structure is a coated or uncoated structure, the surrounding fabric and the manner in which the support structure is attached to the surrounding fabric determines the degree to which the portions of the support structure that are not anchored to the band can adjust and adapt to the movements of the wearer. The degree to which the support structures can adjust in position in response to the fit of the garment on the wearer is also affected by the position of the support structure in the garment (i.e., whether the support structure is disposed on a layer of fabric or between two layers of fabric).

As noted above, in those embodiments where the support structure is a wire encased in fabric, the wires are tacked to the fabric casing to retain the wire in the casing. The wires are tacked by sewing or gluing the ends of the casing to secure the support structure therein. In some embodiments, the support is encased between layers of fabric, these layers functioning as a fabric casing. In addition to tacking, when the wires are plastic or metal wires coated in plastic, the plastic tips of the wire are melted to tack the wire to the casing. This causes the support structure and the casing to move together in response to the adjustments of the garment in response to garment fit or to movement of the wearer.

Although the applicants do not wish to be held to a theory, the attachment of the support structures 170 to the band 160 to form anchor regions 180 below cups 110 brings the anchor point of the garment lower than in conventional garments (to the extent that conventional garments even have an anchor point). Lowering the anchor point to a portion of the garment below the cup portion allows for adjustment based on the size, movement and posture of the wearer.

Figure 6:
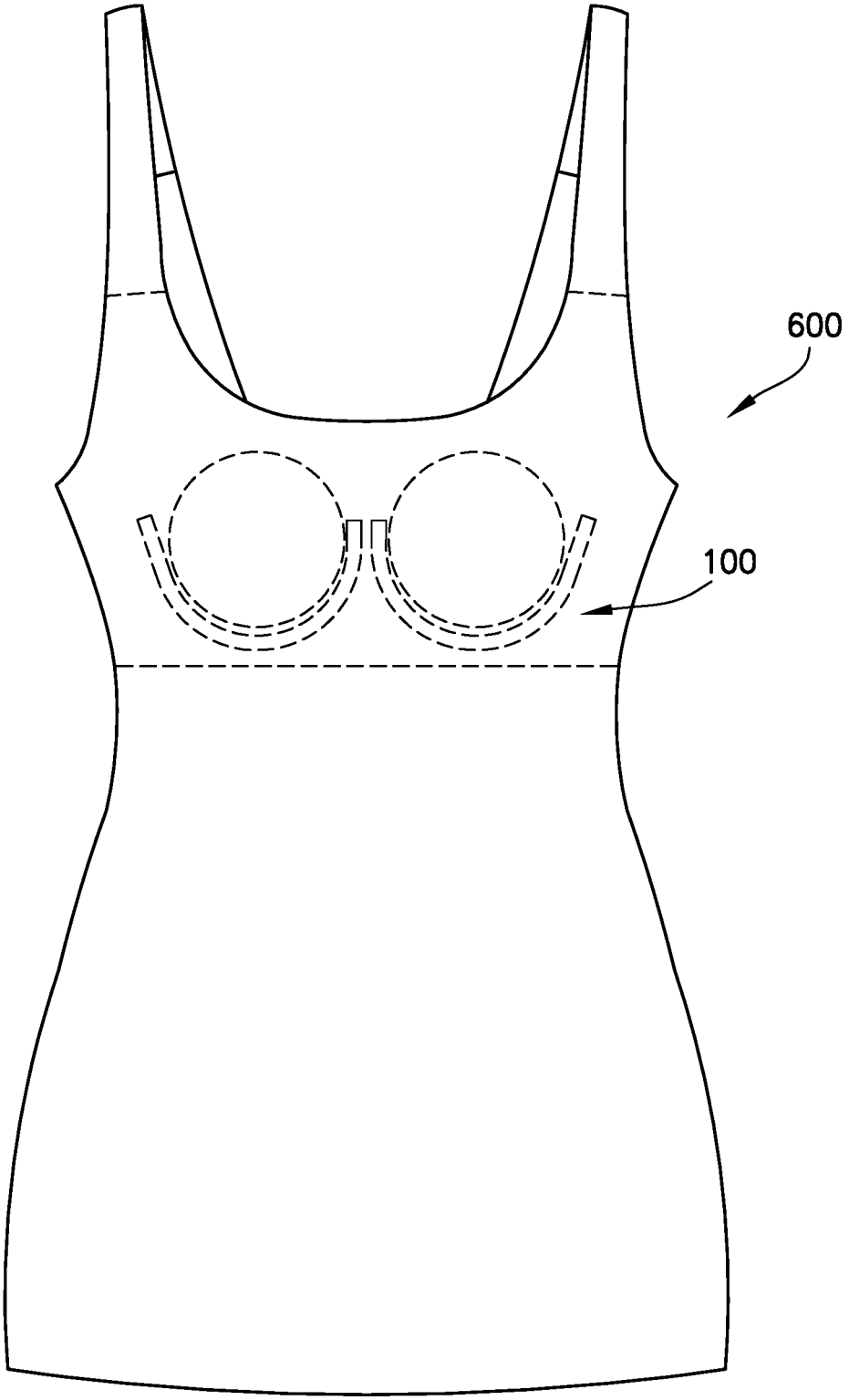
FIG. 6 illustrates the bra portion of FIG. 1 as part of a camisole.
Figure 7:
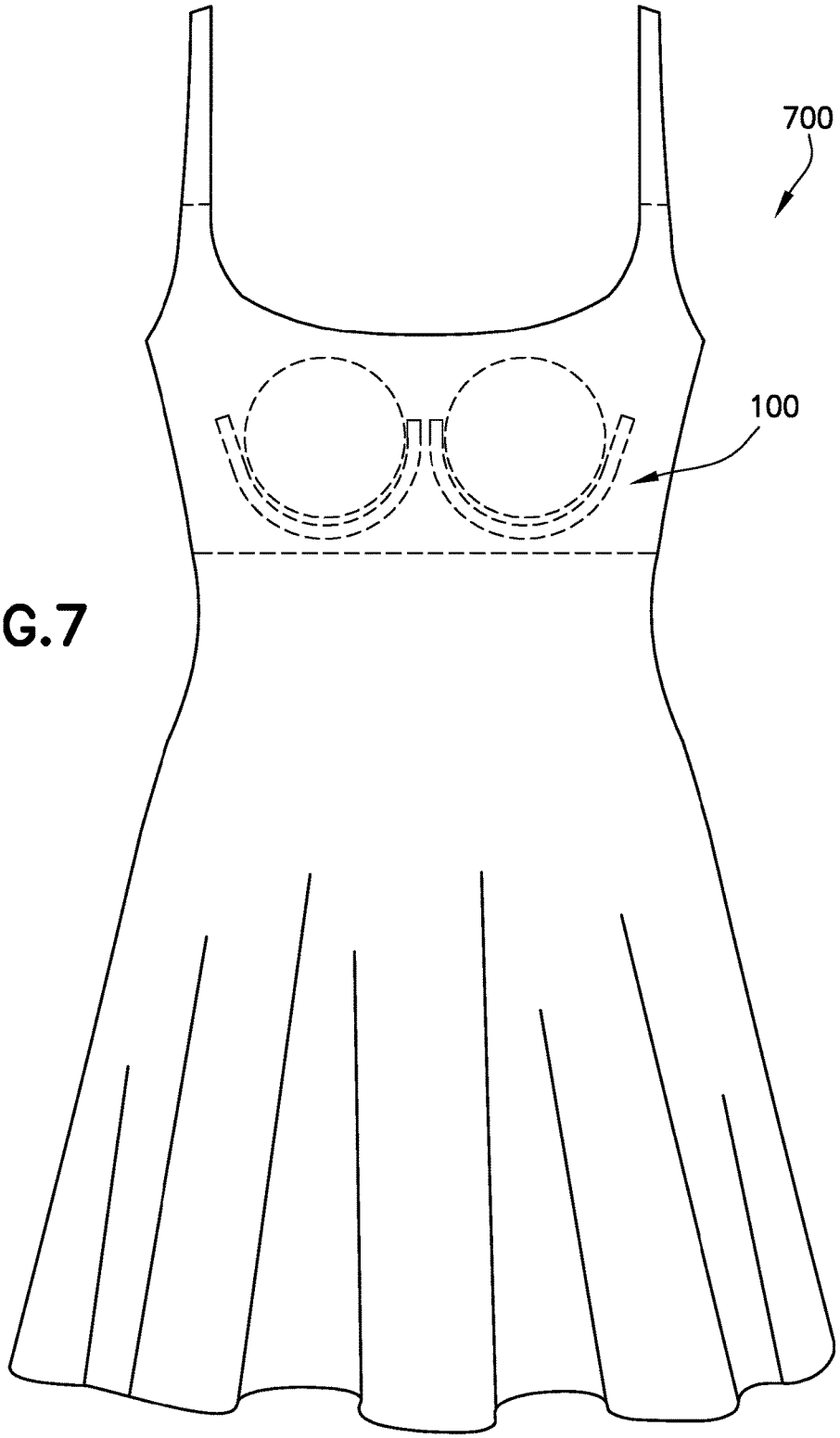
FIG. 7 illustrates a bra portion of FIG. 1 as part of a sun dress.
Figure 8:
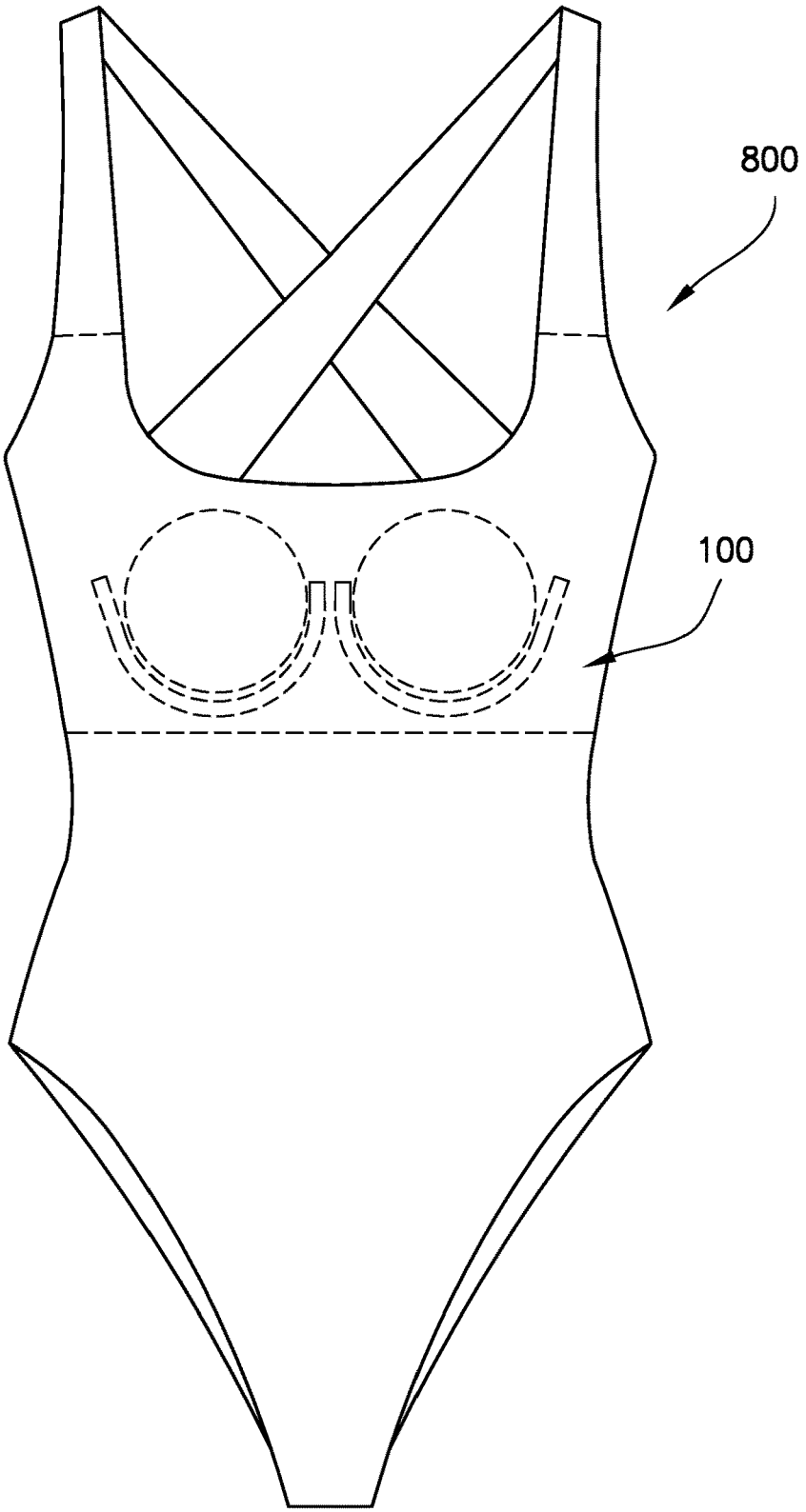
FIG. 8 illustrates a bra portion of FIG. 1 as part of a swimsuit.

As noted above, the garment as described above can be a bra or brassiere, or a bra or brassiere portion of an undergarment or shapewear garment (camisoles, long line bra, body briefer; etc.) or active wear (e.g. swimwear). Other embodiments include the garment described above incorporated into a sun dress or other conventional garment. Examples of the garments enumerated above are non-limiting. The garment 100 incorporated into a camisole 600 is illustrated in FIG. 6. The garment 100 incorporated into a sun dress is illustrated as 700 in FIG. 7. The garment 100 incorporated into a swim suit 800 is illustrated in FIG. 8.

Also described herein is a method for forming a garment with a bra or brassiere portion. According to the method a body fabric is provided from which the bra or brassiere portion is formed. A cup portion with two cups is formed in the body portion. In one embodiment, the cups are molded body fabric. In other embodiments cups are attached to the body fabric. Attachment is accomplished by any conventional means (e.g. sewing, gluing etc.). In this manner, the cup portion is integrated with the body portion. A band is formed on the portion of the garment below the cup portion. That band can be an elastic band, folded over fabric, silicone, etc. The band has a certain degree of elasticity or stretch. Support structures are assembled with the garment. Support structures include metal or plastic wires. Those metal or plastic wires can be coated or uncoated. The support structures also include metal or plastic wires disposed in a fabric casing.

A portion of the support structures are affixed to the band of material. The support structures are affixed to the band of material using any conventional technique (e.g. sewing, gluing, etc.). The sewing or gluing introduces a region on the band of material that stretches less than the adjacent portions of the band. The area of attachment between the support structure and the band of material is an anchor.

As noted above, in those embodiments where the support structure is a wire in a fabric casing, the casing is tacked to retain the wire within the casing. In one embodiment, the casing is the approximate length of the wire. As illustrated in FIG. 3, the casings are tacked at the ends to retain the wire in the fabric casing. In other embodiments, the casing 201 is longer than the wire (which terminates about at the location 210) and the ends of the casing extend to the garment perimeter. In these embodiments, the wires are tacked in the casing so that they are retained at the location underneath and adjacent the cups. In one embodiment, the wire is a plastic or plastic coated wire. In these embodiments, the plastic at the tip of the wire is melted to tack the wire in the casing.

Figure 4:
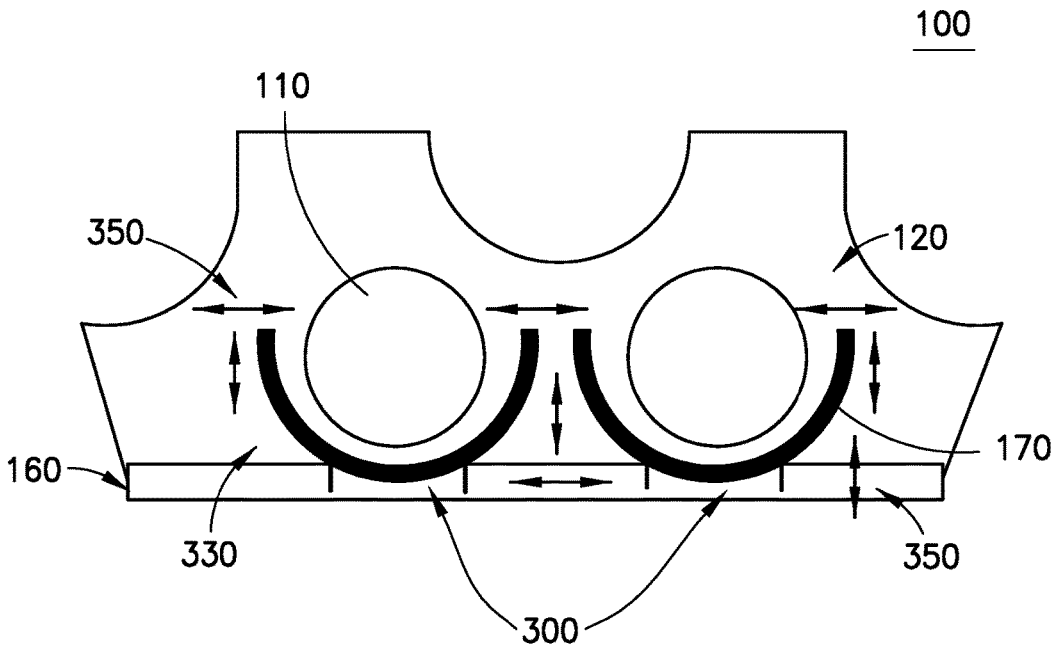
FIG. 4 illustrates the adjustability of an arcuate support structure as the approximate midpoint of the arcuate support structure remains fixed on the band.

As noted above, the portion of the support structures 170 affixed to the body fabric do not create an anchor point but "float" in response to tensions, stresses and strains placed on the garment. Referring to FIG. 4, the anchor 300, or anchor region, is formed when the proximate midpoint or apex of the support structure 170 is fastened to the band 160. The support structure as illustrated, is approximately arcuate in configuration. As illustrated in FIG. 4, the portions 330 of the support structure 170 that do not form the anchor 300 (the anchor 300 is approximately demarked by brackets), will move in response to strain, stress and tension placed on the garment, but the portion of the support structure 170 fixed on the band 160 at 300 does not similarly adjust in response to such tension, stress and strain. The portions of the garment that will stretch in response to tension, stress and strain placed upon the garment are illustrated by arrows 350. Note that, although stretch is illustrated as stretch in x and y directions, the garment will stretch in any direction in the plane of the fabric. The portion of the band that does not form an anchor with the support structure 170 will also stretch in both directions as illustrated in FIG. 4, as will the body fabric 120. Therefore, the ability of the garment to adjust and adapt to the wearer is not a function of the support structure alone, but rather a combination of the resilient support structure, the body fabric, and the band material. Because the support structures 170 can adjust as illustrated in FIG. 4, the garment anchor points provide a solid foundation but allow the other portions of the support structure 170 to move in response to the tensions, strains and stresses to which the garment is subjected when worn, which will cause the body fabric 120 and the band 160 to stretch (except that portion of the band 160 affixed to the support structures).

Figure 5:
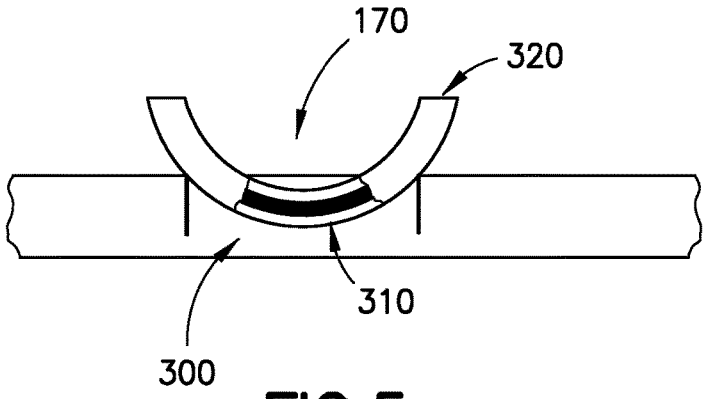
FIG. 5 is a cut away view of a support structure having a casing and exposing the wire within the casing.

A detailed view of one support structure 170 is illustrated in FIG. 5. That support structure is a resilient support 310 disposed in a fabric casing 320. The resilient support 310 is revealed in the cut away portion of the fabric casing 320. As noted above, the position of the resilient support 310 relative to the anchor 300 will adjust in response to the stresses, strains and tensions to which the garment is subjected when worn. It is this adjustment that provides the wearer with comfort, support and a consistently attractive appearance when the garment is worn. In a variant of the above methods, the method includes affixing the support structure to the band so that a first portion of the support structure extending from the location of affixation is longer or shorter than a second portion of the support structure extending in an opposite direction from the location of affixation.

In some embodiments, one or more control regions are formed in the body fabric. Control regions can be formed by adding layers of fabric, adding adhesive to the fabric and other techniques known to one of ordinary skill. The control regions stretch less than the body fabric in response to tensions to which the garment is subjected but stretch more than the anchor regions in response to such tensions. For example, control regions are placed in the region of the body fabric between the cups, in a region of body fabric on the opposite side of the cups (i.e., the sling region) or other locations chosen by the designer to provide a desired form, fit and function to the garment.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being comprised in the present invention. Those in the art will understand that a number of variations may be made in the disclosed embodiments, all without departing from the scope of the invention, which is defined solely by the appended claims.

What is claimed is:

1. A garment comprising:

a cup portion comprising two cups;

a body portion including a body fabric, the body portion shaped to define the cup portion or to attach to the cup portion;

a band formed with the body portion below the cup portion, the band being made of a material that stretches from an original shape when subject to tension;

two arcuate resilient wires, each resilient wire positioned on the garment proximate a contour of a respective cup in the cup portion, wherein each resilient wire includes a first portion encompassing an apex of the arcuate resilient wire, the first portion only attached to the band and forming an anchor region; and a central control region located on the body portion between the two arcuate resilient wires having a material property such that when the garment is subject to tension, wherein the band stretches less at the anchor region than areas of the band outside of the anchor region when the band is subject to tension.

2. The garment of claim 1 wherein the arcuate resilient wires comprise a silicone coating.

3. The garment of claim 1 wherein the arcuate resilient wires are made of plastic.

4. The garment of claim 1 wherein the garment is selected from the group consisting of brassieres, foundation garments, shapewear, swimwear, activewear and sundresses.

5. The garment of claim 1, wherein the body fabric is a multi-ply fabric.

6. The garment of claim 5, wherein the two arcuate resilient wires are disposed between a first ply and a second ply.

7. The garment of claim 1, wherein each of the two arcuate resilient wires are disposed in a fabric casing.

8. The garment of claim 7, wherein each of the two arcuate resilient wires disposed in the fabric casing has first and second ends and each fabric casing extends beyond at least one end of the resilient wire to a location at a perimeter of the garment.

9. The garment of claim 1, wherein the band is selected from the group consisting of an elastic band, folded over fabric, lace and silicone.

10. The garment of claim 9 wherein the band is attached to the body fabric.

11. The garment of claim 1, wherein a second portion of each of the two arcuate resilient wires floats such that the second portion of each of the two arcuate resilient wires does not form an anchor with the body fabric.

12. The garment of claim 1 wherein, when the garment is subjected to tension, the control region stretches less than the body fabric.

13. The garment of claim 1, wherein, when the garment is subject to tension, the control region stretches more than the anchor region.

14. A garment comprising:

a body portion including a body fabric;

a cup portion including two cups, the cup portion shaped from the body portion or attached to the body portion;

a band connected to the body portion below the cup portion, the band configured to stretch from an original shape when subject to tension and to return to the original shape when such tension is removed;

two curved resilient wires each positioned on the garment proximate a contour of a respective cup in the cup portion, the curved resilient wires each comprising:

a first portion encompassing an apex of the curved resilient wires, the first portion attached only to the band and forming an anchor region; and a second portion attached to the body portion, wherein the band at the anchor region resists stretching in response to tension to a greater degree than other locations on the band when subject to tension, and wherein the second portion of each of the two curved resilient wires float such that the second portion of the curved resilient wires does not form an anchor with the body fabric.

15. The garment of claim 14, wherein the curved resilient wires are affixed to the band by at least one of gluing or sewing.

16. The garment of claim 14, wherein the band is a stretchable material.

17. The garment of claim 16 wherein the stretchable material for the band is selected from the group consisting of an elastic band, folded over fabric, lace and silicone.

18. The garment of claim 16, wherein the band is attached to the body fabric.

19. The garment of claim 16 wherein the band is formed from the body fabric.

20. The garment of claim 14, wherein the body fabric is a multi-ply fabric.

21. The garment of claim 20, wherein the curved resilient wires are disposed between a first ply and a second ply.

22. The garment of claim 14, wherein each of the two curved resilient wires comprises a silicone coating.

23. The garment of claim 22, wherein the silicone of the curved resilient wires is affixed to the band and forms the anchor region.

24. The garment of claim 14, wherein the two curved resilient wires are each made of plastic.

25. The garment of claim 14, wherein the garment is selected from the group consisting of brassieres, foundation garments, shapewear, swimwear, activewear and sundresses.

26. A garment comprising:

a cup portion;

a body portion including a body fabric, the body portion shaped to define the cup portion or to attach to the cup portion;

a band disposed on or adjacent to the body portion below the cup portion, the band capable of stretching when subjected to tension; and a resilient wire corresponding to a contour of a cup in the cup portion, the resilient wire having an apex portion attached only to an area of the band thereby forming an attachment area, the attachment area defining an anchor region, wherein the band stretches less at the anchor region than at other locations on the band when the band is subject to tension and wherein the resilient wire is made of a material selected from the group consisting of metals or synthetic materials.

27. The garment of claim 26 wherein the resilient wire comprises a silicone coating.

28. The garment of claim 26 wherein the resilient wire is made of plastic.

29. The garment of claim 26 wherein the garment is selected from the group consisting of brassieres, foundation garments, shapewear, swimwear, activewear and sundresses.

30. The garment of claim 26 wherein the band does not stretch at the anchor regions and stretches at other locations on the band when the band is subject to tension.

* * * * *